US008091379B2

(12) United States Patent
Choi

(10) Patent No.: US 8,091,379 B2
(45) Date of Patent: Jan. 10, 2012

(54) REFRIGERATOR

(75) Inventor: Dae-Jin Choi, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 624 days.

(21) Appl. No.: 12/249,434

(22) Filed: Oct. 10, 2008

(65) Prior Publication Data

US 2009/0100859 A1 Apr. 23, 2009

(30) Foreign Application Priority Data

Oct. 15, 2007 (KR) ..... 10-2007-0103711

(51) Int. Cl.
*F25D 11/00* (2006.01)

(52) U.S. Cl. ..... 62/440
(58) Field of Classification Search ..... 62/132, 62/440
See application file for complete search history.

(56) References Cited

U.S. PATENT DOCUMENTS

2006/0224050 A1* 10/2006 Lee et al. ..... 600/300
* cited by examiner

*Primary Examiner* — Melvin Jones
(74) *Attorney, Agent, or Firm* — Birch, Stewart, Kolasch & Birch, LLP

(57) ABSTRACT

Disclosed is a refrigerator having a sensor cover slidingly-coupled to inside of a cooling chamber and accommodating a sensor therein. Since the sensor cover is easily coupled to or separated from the cooling chamber, damage of components is prevented.

18 Claims, 8 Drawing Sheets

REFRIGERATOR

RELATED APPLICATION

The present disclosure relates to subject matter contained in priority Korean Application No. 10-2007-0103711, filed on Oct. 15, 2007, which is herein expressly incorporated by reference in its entirety.

BACKGROUND OF THE INVENTION

1. Field of the Invention

The present invention relates to a refrigerator, and more particularly, to a refrigerator capable of facilitating detachable mounting of a sensor cover to inside of a cooling chamber, and capable of preventing damage of components.

2. Background of the Invention

In general, a refrigerator serves to store food items therein in a cool state. The refrigerator includes a refrigerator body having a cooling chamber, a door for opening and closing the refrigerator body, and a refrigerating cycle for supplying cool air to the cooling chamber.

In the cooling chamber of the refrigerator body provided are a temperature sensor for maintaining an inner temperature as a preset temperature, and a sensor cover for supporting the temperature sensor.

The conventional sensor cover may be fixed to the cooling chamber by screws. In this case, additional tools are required, and it takes a lot of time to couple or separate the sensor cover to/from the cooling chamber.

In order to solve the problems, a hook may be provided at the sensor cover, and a hook engaging portion for engaging the hook may be formed on an inner wall of the cooling chamber. However, in this case, it is difficult to separate the hook from the hook engaging portion, thus to have a difficulty in separating the sensor cover from the cooling chamber. Furthermore, when an excessive force is applied to the hook for separation from the hook engaging portion, the hook and/or the hook engaging portion may be damaged.

SUMMARY OF THE INVENTION

Therefore, an object of the present invention is to provide a refrigerator capable of easily coupling and separating a sensor cover to/from a cooling chamber.

Another object of the present invention is to provide a refrigerator capable of easily coupling and separating a sensor cover to/from a cooling chamber, and capable of preventing damage of components.

Still another object of the present invention is to provide a refrigerator capable of easily coupling and separating a sensor cover to/from a cooling chamber, and capable of preventing the sensor cover having been coupled to the cooling chamber from being suddenly separated from the cooling chamber.

To achieve these and other advantages and in accordance with the purpose of the present invention, as embodied and broadly described herein, there is provided a refrigerator, comprising: a refrigerator body having a cooling chamber therein; a sensor arranged in the cooling chamber; and a sensor cover sliding-coupled to the cooling chamber so as to accommodate the sensor therein.

The refrigerator may further comprise a rib formed at one of the sensor cover and the cooling chamber along a sliding direction of the sensor cover; and a rib supporting portion for slidably supporting the rib.

Here, the rib may be formed at both sides of the sensor cover, respectively.

Here, at one side of the rib supporting portion, may be formed an insertion hole penetratingly formed so as to insert the rib, and a slit extending from the insertion hole along a moving direction of the sensor cover.

The refrigerator may further comprise a sliding preventing portion for preventing the sensor cover having been coupled to the cooling chamber from sliding.

Here, the sliding preventing portion may comprise: a protruding portion more protruding than the rib along a protruding direction of the rib; and an accommodating portion for accommodating the protruding portion.

Here, the protruding portion may be configured to be more protruding than the rib along a thickness direction.

Here, the rib supporting portion may comprise: a protruding section protruding from an inner surface of the cooling chamber; and a bending section bent from the protruding section.

Here, the rib may be formed in plurality in number at one or more sides of the sensor cover along a width direction of the sensor cover.

Here, the rib supporting portion may be formed in plurality in number at one or more sides of the sensor cover along a width direction of the sensor cover.

Here, the refrigerator may further comprise a sliding preventing portion for preventing the sensor cover having been coupled to the cooling chamber from sliding.

Here, the sliding preventing portion may comprise: a protruding portion protruding from one of the rib and the rib supporting portion; and an accommodating portion formed at the other of the rib and the rib supporting portion, and accommodating the protruding portion.

Here, a sensor supporting portion for supporting the sensor may be formed on an inner surface of the sensor cover.

Here, the sensor supporting portion may be respectively arranged at both sides of the sensor, and elastically comes in contact with the sensor.

Here, an air passing hole may be formed at the sensor cover so that inside and outside of the sensor cover can communicate with each other.

Here, a through hole may be formed at a rear end of the sensor cover along a sliding direction of the sensor cover when coupling the sensor cover to the cooling chamber.

To achieve these and other advantages and in accordance with the purpose of the present invention, as embodied and broadly described herein, there is also provided a refrigerator, comprising: a refrigerator body having a cooling chamber therein; a sensor arranged in the cooling chamber; a sensor cover having a body to accommodate the sensor therein, and ribs protruding from both sides of the body and extending along a longitudinal direction of the body; and rib supporting portions formed so as to slidingly-contact the ribs, and supporting the ribs, wherein an insertion hole for inserting the rib is formed at one end of the rib supporting portion along a sliding direction of the body, and wherein a slit for inserting and moving the body is formed at one side of the supporting rib along a width direction of the body.

Here, the refrigerator may further comprise a sliding preventing portion for preventing the sensor cover having been coupled to the cooling chamber from sliding.

Here, the sliding preventing portion may comprise: a protruding portion more protruding than the rib along a protruding direction of the rib; and an accommodating portion configured to accommodate the protruding portion.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

Hereinafter, a refrigerator according to a first embodiment of the present invention will be explained.

Figure 1:
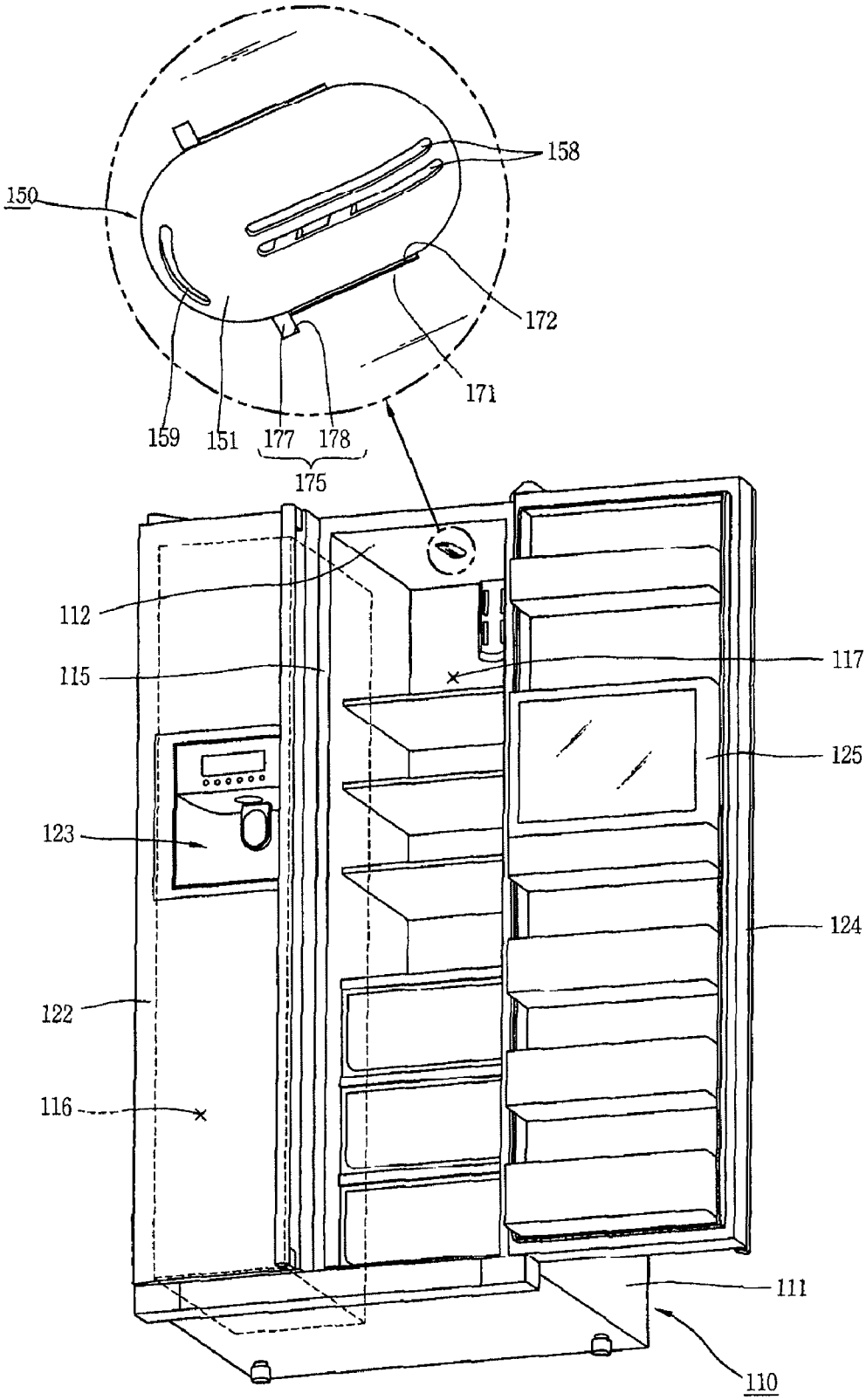
FIG. 1 is a perspective view showing a refrigerator according to a first embodiment of the present invention.

As shown in FIG. 1, a refrigerator according to a first embodiment of the present invention comprises a refrigerator body 110 having a cooling chamber therein, doors 122 and 124 coupled to the refrigerator body 110 so as to open and close the cooling chamber, and a sensor cover 150 sliding-coupled to inside of the cooling chamber. Here, the cooling chamber indicates a freezing chamber and a refrigerating chamber, and the refrigerator body may be provided with one of the freezing chamber and the refrigerating chamber. The sensor cover may be provided at one or more positions among an inner wall of the cooling chamber, the ceiling, the floor, and an inner wall of a door, in one or plurality in number. Hereinafter, it is assumed that the sensor cover is installed on the ceiling of the refrigerating chamber, The refrigerator body 110 may be provided with a freezing chamber 116 and a refrigerating chamber 117 partitioned from each other by a partition wall 115 formed in upper and lower directions. The refrigerator body 110 includes a cabinet 111 that forms the appearance, and an inner case 112 disposed in the cabinet 11 with a filling space for a foaming agent 113.

The freezing chamber door 122 and the refrigerating chamber door 124 for opening and closing the freezing chamber 116 and the refrigerating chamber 117, respectively are provided at a front surface of the refrigerator body 110. The refrigerating chamber door 122 is provided with a dispenser 123 through which water or ice cubes are discharged out. A home bar 125 may be provided at the refrigerating chamber door 124.

Figure 2:
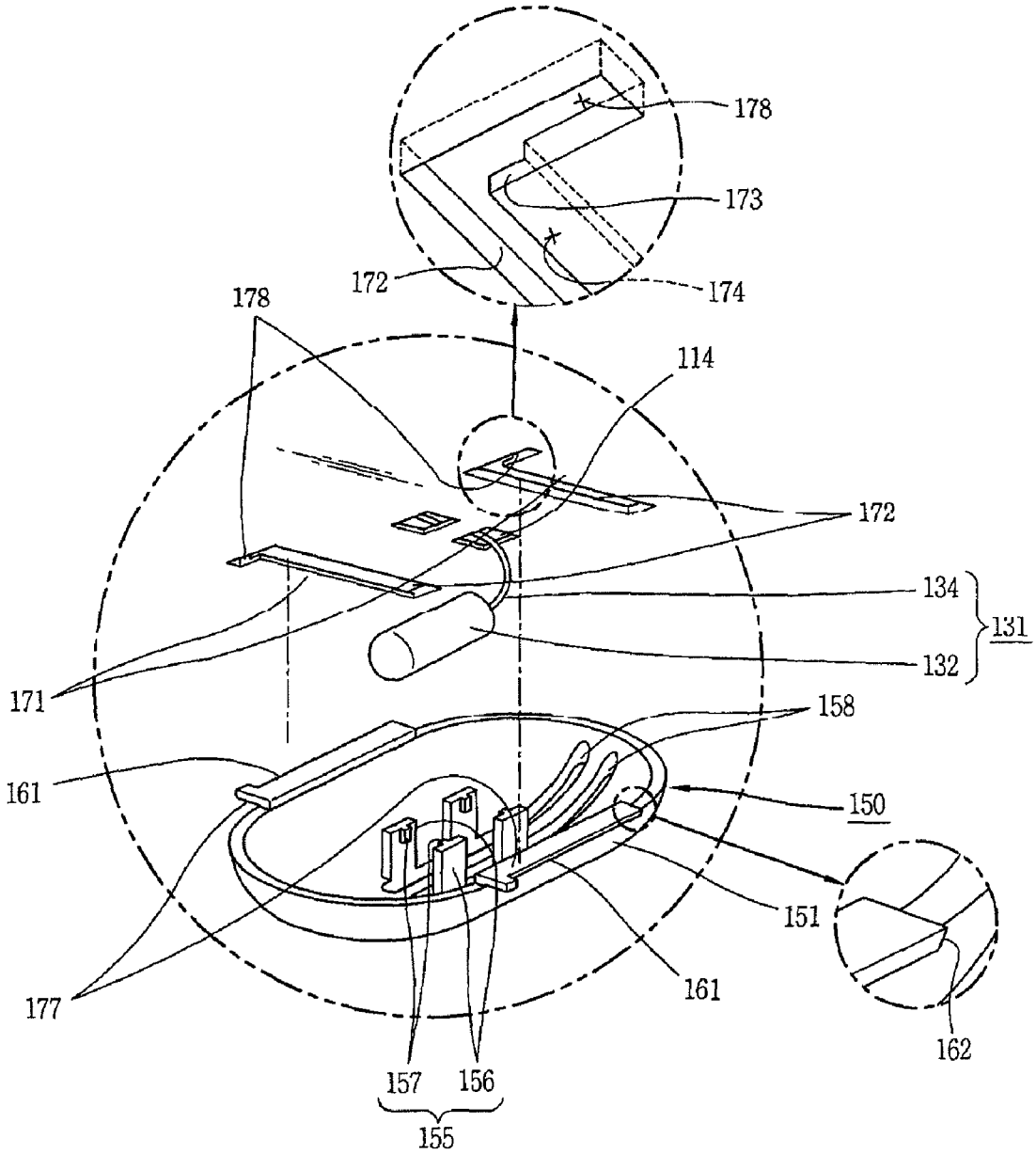
FIG. 2 is an exploded perspective view showing a disassembled state of a sensor cover of FIG. 1.

A temperature sensor 131 for sensing an inner temperature of the refrigerating chamber 117 is provided on the ceiling of the refrigerating chamber 117. As shown in FIG. 2, the temperature sensor 131 includes a temperature sensing portion 132 for sensing a temperature of air in a contact manner, and an electric cord 134 connected to the temperature sensing portion 132 and transmitting a temperature value detected by the temperature sensing portion 132 to a controller (not shown) in the form of an electric signal. The temperature sensing portion 132 is formed to have a bar shape. The electric cord 134 is arranged on the ceiling of the refrigerating chamber 117, more concretely, in the inner case 112. A drawing hole 114 through which the electric cord 134 is drawn out is formed at the inner case 112. The temperature sensing portion 132 is connected to an exposed end of the electric cord 134.

The sensor cover 150 is provided with a body 151 having an accommodating space therein. The body 151 has a shape cut from an approximate oval sphere.

Ribs 161 protruding from the body 151 along a width direction and extending along a length direction of the body 151 are formed at both sides of the body 151. Each of the ribs 161 is formed to have a long plate shape. The ribs 161 are protruding from an opened plane of the body 151 by a certain length along a thickness direction of the body 151. The body 151 and the ribs 161 are connected to each other by a connection portion that will be later explained. A sensor supporting portion 155 for supporting the temperature sensor 131 may be provided in the body 151. The sensor supporting portion 155 is provided with a plurality of supporting ribs 156 protruding from an inner surface of the body 151 and spacing from each other so as to insert the temperature sensor 131 therebetween. Here, the supporting ribs 156 are formed in two pairs. Between the supporting ribs 156, the temperature sensing portion 132 of the temperature is sensor 131 is inserted to be supported. The supporting ribs 156 are formed so as to be elastically deformed. As the supporting ribs 156 elastically come in contact with the temperature sensing portion 132, the temperature sensing portion 132 is prevented from slightly moving with an air gap. A protrusion 157 may be formed on an inner surface of the supporting rib 156, thereby preventing the temperature sensing portion 132 from being separated from the supporting rib 156.

Figure 3:
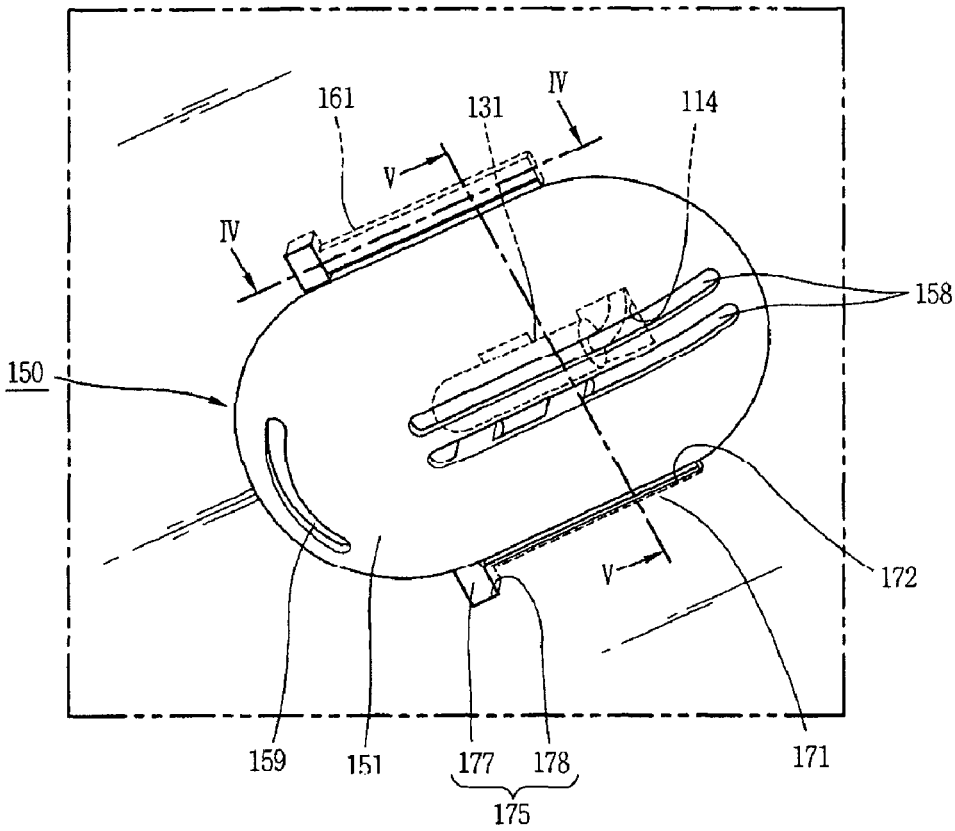
FIG. 3 is a perspective view showing an assembled state of the sensor cover of FIG. 2.
Figure 4:
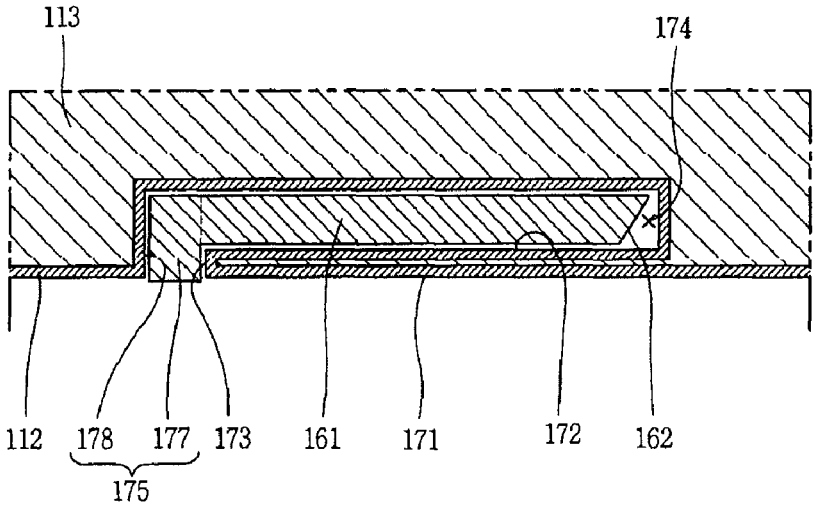
FIG. 4 is a sectional view taken along line 'IV-IV' in FIG. 3.

Between the supporting ribs 156, air passing holes 158 may be formed so that air can be communicated with inside and outside of the body 151. Accordingly, air is smoothly introduced into or discharge out of the body 151 of the sensor cover 150, thereby precisely detecting a temperature of the air. As shown in FIG. 3, a communication hole 159 may be formed at a rear end of the sensor cover 150 along a coupling direction of the sensor cover 151. Accordingly, air can be smoothly communicated between inside and outside of the body 151. Furthermore, the body 151 can be easily detached from the cooling chamber by being easily held by a user. As shown in FIGS. 2 and 4, an inclination portion 162 for smoothly inserting the rib 151 into an insertion hole 173 is formed at a fore end of the rib 161.

As shown in FIG. 2, a rib supporting portion 171 for slidably supporting the rib 161 when coupling or separating the body 151 to/from the cooling chamber is formed near the drawing hole 114. The rib 171 is disposed at a rear side of the rib supporting portion 171. For this, a rib accommodating space 174 is formed behind the rib supporting portion 171. An insertion hole 173 through which each rib 161 is inserted into each rib accommodating space 174 is formed at a rear end of each rib supporting portions 171 along a coupling direction of the body 151. At one side of the rib supporting portion 171, formed is a slit 172 cut along a longitudinal direction so as to insert a connection portion 152 protruding to be connected to one region of the body 151, more concretely, the rib 161.

The rib 161 and the rib supporting portion 171 may be provided with a sliding preventing portion 175 for preventing the sensor cover 150 having been coupled to the cooling chamber from sliding. The sliding preventing portion 175 may include a protruding portion 177 protruding from the end of each rib 161 along a width direction of the rib 161, and an accommodating portion 178 engaged with the protruding portion 177 by accommodating the protruding portion 177 in the cooling chamber.

The protruding portion 177 is more protruding than the rib 161 along a width direction and a thickness direction of the rib 161. The accommodating portion 178 is more extending than the insertion hole 173 in correspondence to the shape of the protruding portion 177. Under these configurations, once the sensor cover 150 is coupled to the cooling chamber, the protruding portion 177 is inserted into the accommodating portion 178, thereby preventing the sensor cover 150 from sliding in back and forth directions, and from moving in right and left directions.

Figure 5:
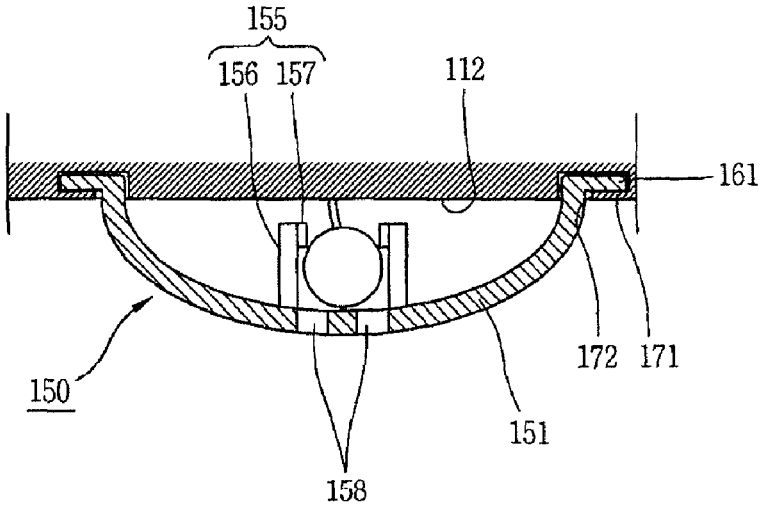
FIG. 5 is a sectional view taken along line 'V-V' in FIG. 3.
Figure 6:
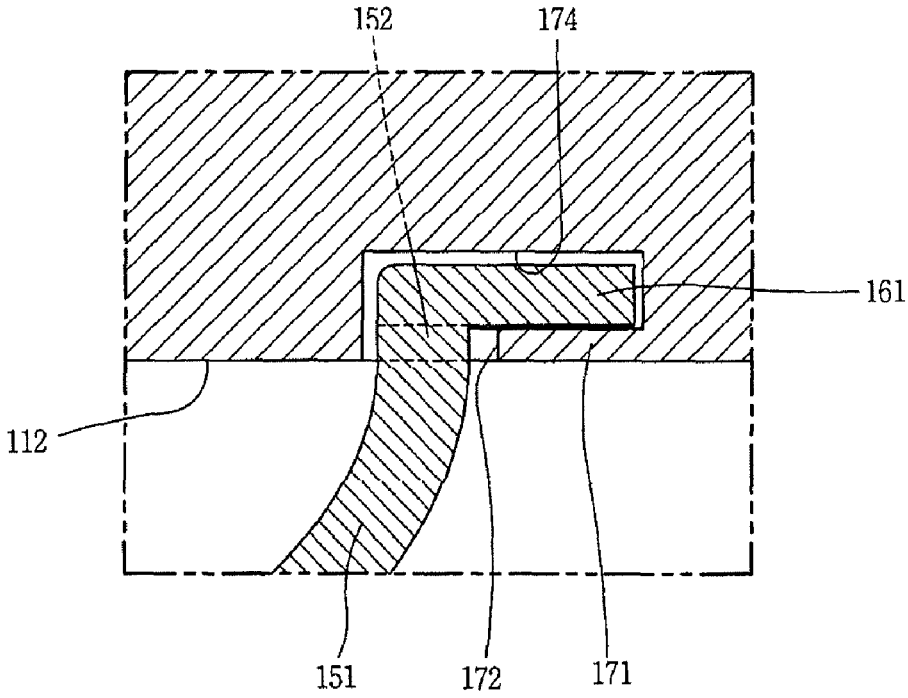
FIG. 6 is an enlarged sectional view showing a main part of FIG. 5.

When coupling the sensor cover 150 to the ceiling of the cooling chamber, the temperature sensing portion 132 drawn out through the drawing hole 114 is inserted into the sensor supporting portion 155. As shown in FIG. 5, the temperature sensor 131 is inserted between the sensor supporting portions 155, and is supported by locking portions 157, thereby being prevented from slightly moving with an air gap or being separated from the sensor supporting portion 155. Then, both front ends of the ribs 161 are inserted into the insertion holes 173. Here, the inclination portion 162 serves to smoothly contact an inlet end of the is supporting rib 171, thereby smoothly inserting the ribs 161 into the insertion holes 173. Then, the rib 161 is pressurized so as to be slidable along the rib supporting portion 171. Once the rib 161 moves along the rib supporting portion 171, the protruding portion 177 is inserted into the accommodating portion 178. Accordingly, the sensor cover 150 is prevented from sliding in back and forth directions, and from moving in right and left directions.

When the sensor cover 150 is to be separated from the ceiling of the cooling chamber, a rear end of the sensor cover 150 is downwardly pressed along a coupling direction of the sensor cover 150, thereby drawing out the protruding portion 177 from the accommodating portion 178. Here, when a user holds the through hole 159 formed at a rear end of the sensor cover 150, the sensor cover 150 may be more easily detached from the cooling chamber. Once the sensor cover 150 is backward pulled, the ribs 161 are extracted from the rib accommodating space 174 through the accommodating portion 178 while sliding along the rib supporting portion 171.

Hereinafter, will be explained a refrigerator according to a second embodiment of the present invention with reference to FIGS. 7 to 11. The same reference numerals will be given to the same parts as those of the first embodiment, and their detailed explanations will be omitted.

Figure 7:
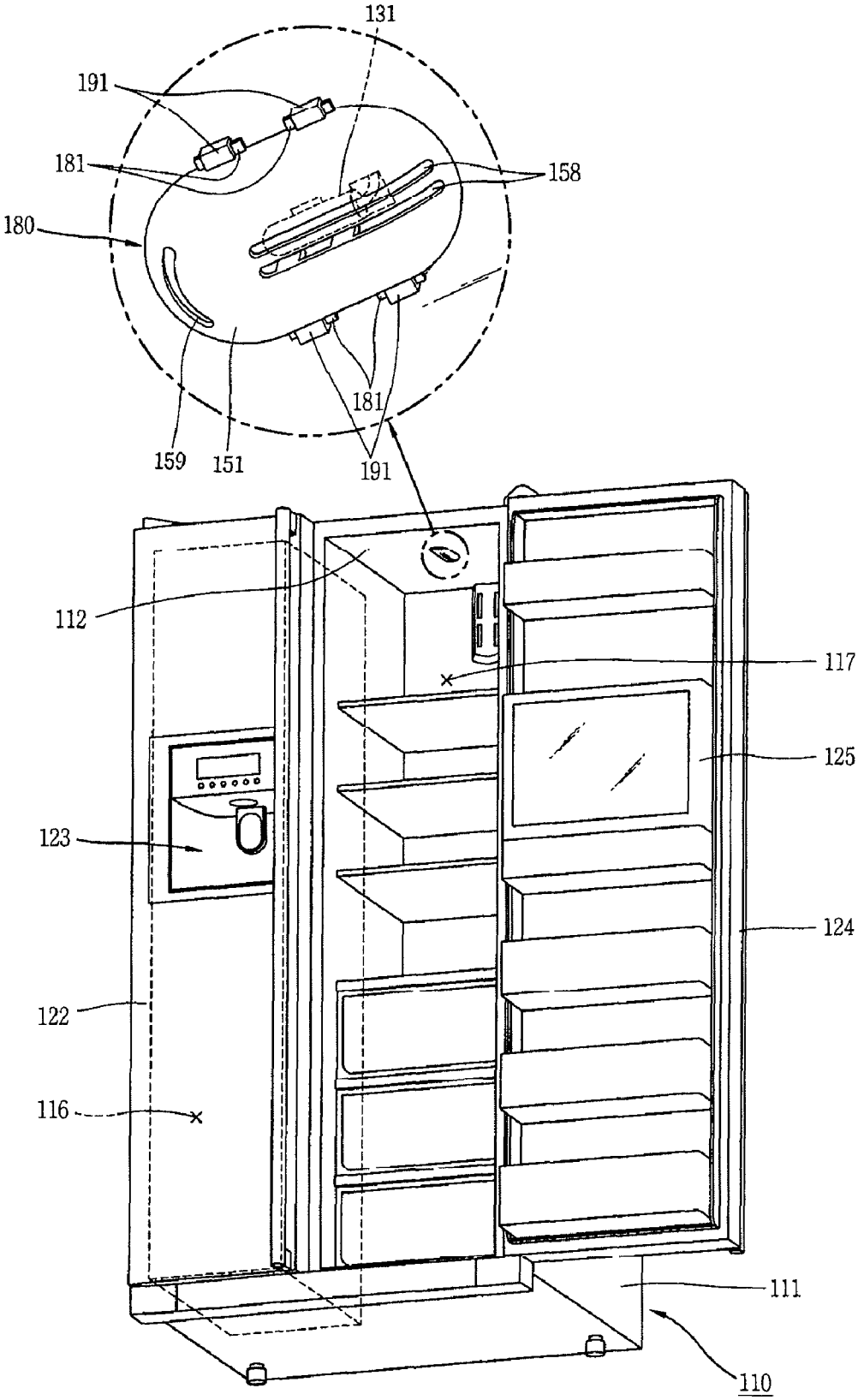
FIG. 7 is a perspective view showing a refrigerator according to a second embodiment of the present invention.

As shown in FIG. 7, a refrigerator according to a second embodiment of the present invention comprises a refrigerator body 110 having a freezing chamber 116 and a refrigerating chamber 117 therein, doors 122 and 124 coupled to the refrigerator body 110 so as to open and close the freezing chamber 116 and the refrigerating chamber 117, and a sensor cover 180 sliding-coupled to inside of the freezing chamber 116 and the refrigerating chamber 117.

Figure 8:
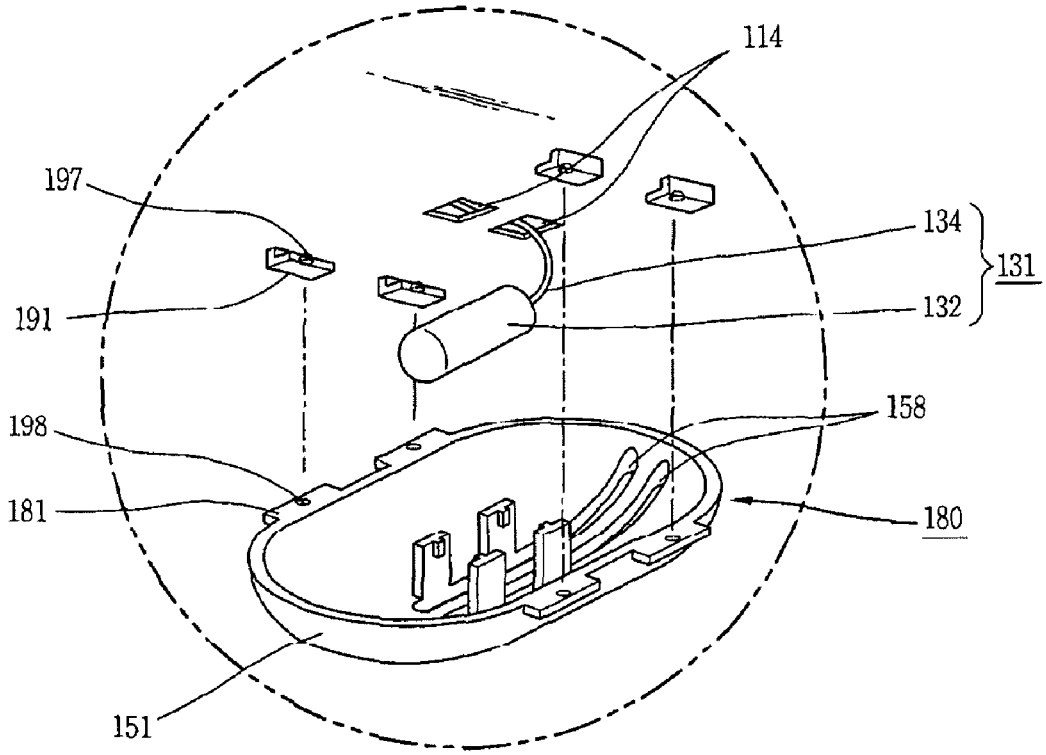
FIG. 8 is an exploded perspective view showing a disassembled state of a sensor cover of FIG. 7.

A temperature sensor 131 for sensing an inner temperature of the refrigerating chamber 17 is provided on the ceiling of the refrigerating chamber 117. As shown in FIG. 8, the temperature sensor 131 includes a temperature sensing portion 132 for sensing a temperature of air in a contact manner, and an electric cord 134 for transmitting a temperature value sensed by the temperature sensing portion 132 to a controller (not shown) in the form of an electric signal. The electric cord 134 is arranged in the inner case 112 of the refrigerating chamber 117, and has one end exposed out through a drawing hole 114. The temperature sensing portion 132 is connected to an exposed end of the electric cord 134.

Figure 9:
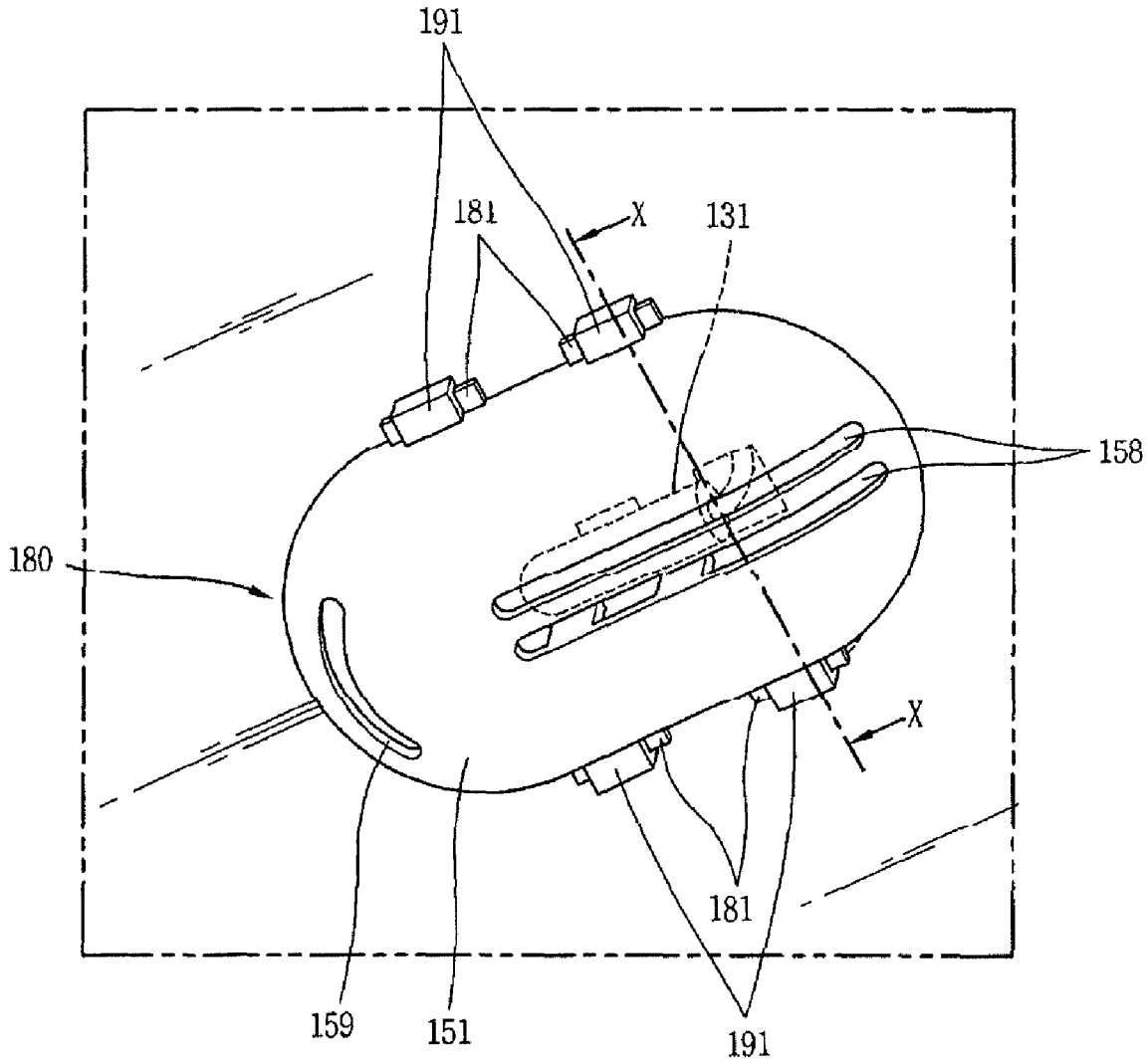
FIG. 9 is a perspective view showing an assembled state of the sensor cover of FIG. 8.

The sensor cover 180 includes a body 151 having an accommodating space therein, and ribs 181 outwardly protruding from both sides of the body 151. Here, each of the ribs 181 is formed so that its inner surface can be parallel to an opened plane of the body 151 so as to contact the inner case 112. As shown in FIG. 9, the ribs 181 are formed in two pairs at both sides of the body 151 in correspondence to the number of rib supporting portions 191. However, the ribs 181 may be formed in one pair at both sides of the body 151 with a relatively long shape.

The rib supporting portion 191 for slidably supporting the rib 181 is formed near the drawing hole 114. The rib supporting portion 191 includes a protruding section 192 protruding from a planar surface of the inner case 112, and a bending section 193 horizontally bent from the end of the protruding section 192. Preferably, the rib supporting portion 191 is formed so as to be elastically deformed.

Figure 10:
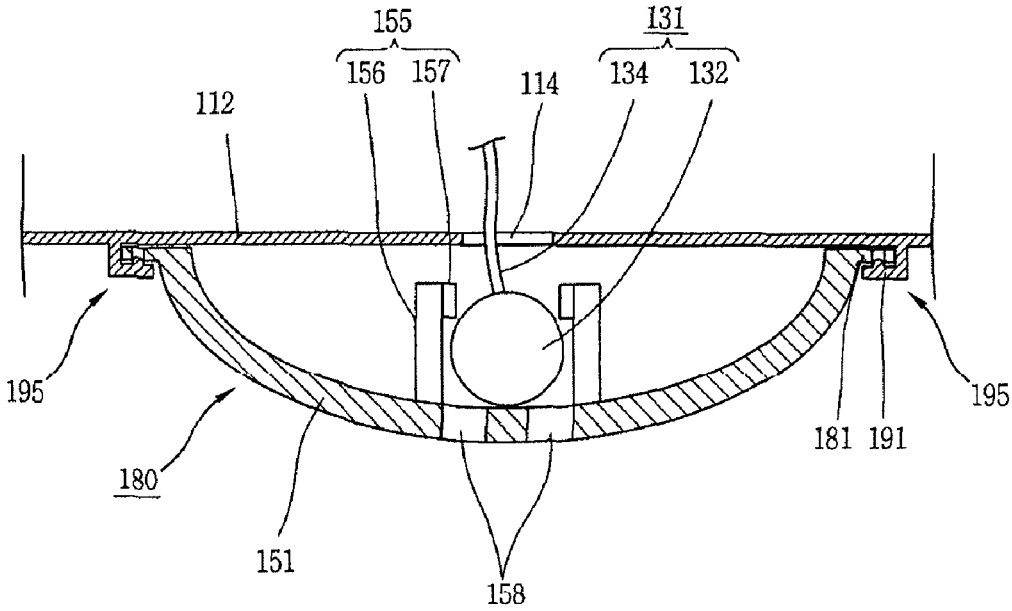
FIG. 10 is a sectional view taken along line 'X-X' in FIG. 9.
Figure 11:
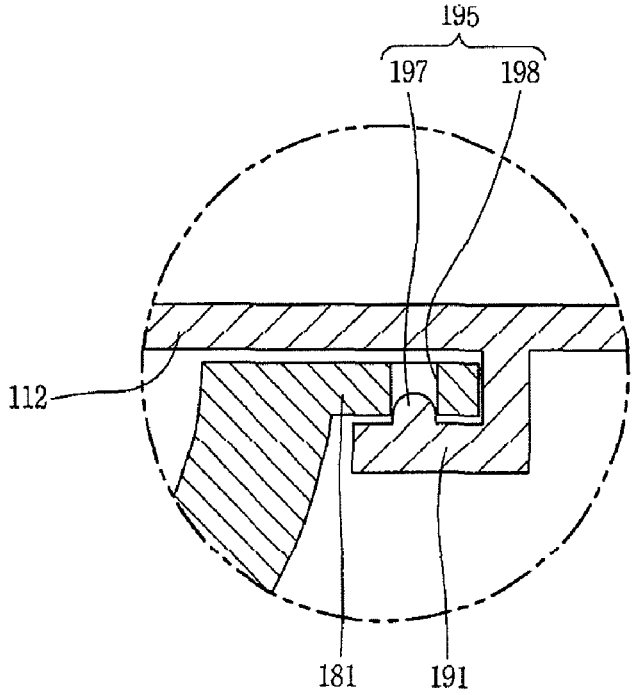
FIG. 11 is an enlarged view showing a motion preventing unit of FIG. 10.

As shown in FIGS. 10 and 11, a sliding preventing portion 195 for preventing the sensor cover 180 from sliding may be formed at each rib 181 and each rib supporting portion 191. The sliding preventing portion 195 may include a protruding portion 197 protruding from one of contact surfaces between the rib 181 and the rib supporting portion 191 towards the other, and a receiving portion 198 formed at another of the contact surfaces and accommodating the protruding portion 197.

The protruding portion 197 is implemented as a protrusion protruding from a planar surface of the bending section 193 of each rib supporting portion 191. The accommodating portion 198 is implemented as a through hole penetratingly formed at the rib 181. Here, the accommodating portion 198 may be implemented as a groove concaved by a certain depth along a thickness direction so as to accommodate the end of the protrusion 197 therein.

Under these configurations, the temperature sensor 131 is coupled to inside of the sensor cover 180, and one end of each rib 181 is arranged at one side of each rib supporting portion 191 along the ceiling. Then, the sensor cover 180 is pressed to move along a planar surface direction of the inner case 112, so that each rib 181 can be inserted into each rib supporting portion 191. As a result, each rib 181 is inserted into each rib supporting portion 191 thus to perform a sliding motion. Once each protruding portion 197 comes in contact with each rib 181, each rib supporting portion 191 is elastically deformed to be outwardly widened, and each protruding portion 197 performs a relative sliding motion with maintaining an elastic contact state with each rib 181.

Once each accommodating portion 198 reaches each protruding portion 197, each rib supporting portion 191 is restored to the initial position by its own elastic force. Accordingly, each protruding portion 197 is inserted into each accommodating portion 198. This prevents the sensor cover 180 from sliding in back and forth directions, and allows a coupled state of the sensor cover 180 to be maintained when a relatively small external force such as vibration is applied thereto.

The present invention has the following effects.

Firstly, since the sensor cover is slidingly-coupled to an inner wall of the cooling chamber, the sensor cover may be rapidly and easily coupled to or separated from the inner wall.

Secondly, since the sensor cover is slidingly-coupled to an inner wall of the cooling chamber without a great force, damage of the components may be prevented.

Thirdly, since the sensor cover having been coupled to the inner wall of the cooling chamber is prevented from sliding by the sliding preventing portion, the sensor cover is prevented from being separated from the inner wall of the cooling chamber due to an external force such as vibration.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator, comprising:

a refrigerator body having a cooling chamber therein;

a sensor arranged in the cooling chamber; and a sensor cover sliding-coupled to the cooling chamber so as to accommodate the sensor therein, wherein an air passing hole is formed at the sensor cover so that inside and outside of the sensor cover can communicate with each other.

2. The refrigerator of claim 1, further comprising:

a rib formed at one of the sensor cover and the cooling chamber along a sliding direction of the sensor cover; and a rib supporting portion for slidably supporting the rib.

3. The refrigerator of claim 2, wherein the rib is formed at both sides of the sensor cover, respectively.

4. The refrigerator of claim 3, wherein at one side of the rib supporting portion, formed are an insertion hole penetratingly formed so as to insert the rib, and a slit extending from the insertion hole along a moving direction of the sensor cover.

5. The refrigerator of claim 3, further comprising a sliding preventing portion for preventing the sensor cover having been coupled to the cooling chamber from sliding.

6. The refrigerator of claim 5, wherein the sliding preventing portion comprises:

a protruding portion more protruding than the rib along a protruding direction of the rib; and an accommodating portion for accommodating the protruding portion.

7. The refrigerator of claim 6, wherein the protruding portion is more protruding than the rib along a thickness direction.

8. The refrigerator of claim 2, wherein the rib supporting portion comprises:

a protruding section protruding from an inner surface of the cooling chamber; and a bending section bent from the protruding section.

9. The refrigerator of claim 8, wherein the rib is formed in plurality in number at one or more sides of the sensor cover along a width direction of the sensor cover.

10. The refrigerator of claim 8, wherein the rib supporting portion is formed in plurality in number at one or more sides of the sensor cover along a width direction of the sensor cover.

11. The refrigerator of claim 8, further comprising a sliding preventing portion for preventing the sensor cover having been coupled to the cooling chamber from sliding.

12. The refrigerator of claim 11, wherein the sliding preventing portion comprises:

a protruding portion protruding from one of the rib and the rib supporting portion; and an accommodating portion formed at the other of the rib and the rib supporting portion, and accommodating the protruding portion.

13. The refrigerator of claim 1, wherein a sensor supporting portion for supporting the sensor is formed on an inner surface of the sensor cover.

14. The refrigerator of claim 13, wherein the sensor supporting portion is arranged at both sides of the sensor, and elastically comes in contact with the sensor.

15. The refrigerator of claim 1, wherein a through hole is formed at a rear end of the sensor cover along a sliding direction of the sensor cover when coupling the sensor cover to the cooling chamber.

16. A refrigerator, comprising:

a refrigerator body having a cooling chamber therein;

a sensor arranged in the cooling chamber;

a sensor cover having a body to accommodate the sensor therein, and ribs protruding from both sides of the body and extending along a longitudinal direction of the body; and rib supporting portions formed so as to slidingly-contact the ribs, and supporting the ribs, wherein an insertion hole for inserting the rib is formed at one end of the rib supporting portion along a sliding direction of the body, and wherein a slit for inserting and moving the body is formed at one side of the supporting rib along a width direction of the body.

17. The refrigerator of claim 16, further comprising a sliding preventing portion for preventing the sensor cover having been coupled to the cooling chamber from sliding.

18. The refrigerator of claim 17, wherein the sliding preventing portion comprises:

a protruding portion more protruding than the rib along a protruding direction of the rib; and an accommodating portion configured to accommodate the protruding portion.

* * * * *